US011504581B2

(12) United States Patent
Beach et al.

(10) Patent No.: US 11,504,581 B2
(45) Date of Patent: Nov. 22, 2022

(54) SYSTEMS AND METHODS FOR INTEGRATING MEASUREMENTS CAPTURED DURING A GOLF SWING

(71) Applicant: Taylor Made Golf Company, Inc., Carlsbad, CA (US)

(72) Inventors: Todd P. Beach, Encinitas, CA (US); Thomas Anthony Kroll, Encinitas, CA (US); David Anderson, Palatine, IL (US); Stephen Anthony Hough, San Diego, CA (US); Nicholas Allan Graham Robbie, San Marcos, CA (US); James Edward Michael Cornish, San Marcos, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 17/696,166

(22) Filed: Mar. 16, 2022

(65) Prior Publication Data

US 2022/0219044 A1 Jul. 14, 2022

Related U.S. Application Data

(63) Continuation of application No. 17/011,678, filed on Sep. 3, 2020.

(Continued)

(51) Int. Cl.
*A63B 24/00* (2006.01)
*A63B 71/06* (2006.01)

(Continued)

(52) U.S. Cl.
CPC ..... *A63B 24/0006* (2013.01); *A63B 69/3605* (2020.08); *A63B 69/3623* (2013.01);

(Continued)

(58) Field of Classification Search
CPC ..... A63B 24/0006; A63B 69/3605; A63B 69/3623; A63B 71/0622;

(Continued)

(56) References Cited

U.S. PATENT DOCUMENTS 6,203,443 B1 3/2001 Britton
9,211,439 B1 12/2015 Pedenko et al.

(Continued)

FOREIGN PATENT DOCUMENTS

AU 2011293130 A1 4/2013
AU 2011313952 A1 6/2013

(Continued)

*Primary Examiner* — Jeffrey S Vanderveen
(74) *Attorney, Agent, or Firm* — Klarquist Sparkman, LLP

(57) ABSTRACT

The present embodiments provide systems and methods for aggregating measurements captured by different technologies during a golf swing. By capturing measurements using different technologies, more accurate measurements may be provided to a user by selecting from the measurements, offsetting measurements based on the technologies used, and aligning measurements between devices. Further, by aggregating measurements received from different devices, additional features and functionality may be provided to the user that is absent from any one device used alone. Additionally, by storing the aggregated measurements, users, club fitters and instructors may access and leverage larger databases of measurements to better understand the user's golf swing and to provide better recommendations and instruction to the user.

21 Claims, 6 Drawing Sheets

Related U.S. Application Data

(60) Provisional application No. 62/897,148, filed on Sep. 6, 2019.

(51) Int. Cl.
*A63B 69/36* (2006.01)
*A63B 102/32* (2015.01)

(52) U.S. Cl.
CPC .. *A63B 71/0622* (2013.01); *A63B 2024/0009* (2013.01); *A63B 2024/0031* (2013.01); *A63B 2071/0647* (2013.01); *A63B 2102/32* (2015.10); *A63B 2220/05* (2013.01); *A63B 2220/62* (2013.01); *A63B 2220/803* (2013.01); *A63B 2220/806* (2013.01); *A63B 2220/89* (2013.01); *A63B 2225/02* (2013.01); *A63B 2225/50* (2013.01)

(58) Field of Classification Search
CPC .... A63B 2024/0009; A63B 2024/0031; A63B 2071/0647; A63B 2102/32; A63B 2220/05; A63B 2220/62; A63B 2220/803; A63B 2220/806; A63B 2220/89; A63B 2225/02; A63B 2225/50
See application file for complete search history.

(56) References Cited

U.S. PATENT DOCUMENTS

| | | | | |
|---|---|---|---|---|
| 10,350,455 | B2 | 7/2019 | Bentley et al. | |
| 2008/0235934 | A1 | 10/2008 | Burnett et al. | |
| 2013/0296078 | A1 | 11/2013 | Solheim et al. | |
| 2018/0071582 | A1 | 3/2018 | Bentley et al. | |
| 2018/0318644 | A1 | 11/2018 | Forsgren | |
| 2020/0155899 | A1* | 5/2020 | Hixenbaugh ..... | A63B 69/3614 |
| 2021/0069548 | A1 | 3/2021 | Beach et al. | |

FOREIGN PATENT DOCUMENTS

| | | | |
|---|---|---|---|
| AU | 2012345966 | A1 | 7/2014 |
| AU | 2013209683 | A1 | 9/2014 |
| AU | 2013251335 | A1 | 12/2014 |
| AU | 2015249884 | A1 | 1/2016 |
| AU | 2011293130 | B2 | 3/2016 |
| AU | 2016204553 | A1 | 7/2016 |
| AU | 2013251335 | B2 | 8/2016 |
| AU | 2015249898 | A1 | 12/2016 |
| AU | 2011313952 | B2 | 4/2017 |
| AU | 2016204553 | B2 | 5/2017 |
| AU | 2015349817 | A1 | 7/2017 |
| AU | 2012345966 | B2 | 2/2018 |
| AU | 2016293613 | A1 | 3/2018 |
| AU | 2016293616 | A1 | 3/2018 |
| AU | 2013209683 | B2 | 6/2018 |
| AU | 2017326614 | A1 | 5/2019 |
| AU | 2015249884 | B2 | 7/2019 |
| AU | 2015249898 | B2 | 7/2019 |
| AU | 2016293616 | B2 | 3/2020 |
| AU | 2015349817 | B2 | 6/2020 |
| AU | 2017326614 | B2 | 1/2021 |
| AU | 2016293613 | B2 | 11/2021 |
| CA | 2812734 | A1 | 3/2012 |
| CA | 2817875 | A1 | 4/2012 |
| CA | 2862209 | A1 | 6/2013 |
| CA | 2865338 | A1 | 7/2013 |
| CA | 2875499 | A1 | 10/2013 |
| CA | 2917542 | A1 | 10/2015 |
| CA | 2983574 | A1 | 10/2015 |
| CA | 3005716 | A1 | 5/2016 |
| CA | 3030958 | A1 | 1/2017 |
| CA | 3031040 | A1 | 1/2017 |
| CA | 2812734 | C | 9/2017 |
| CA | 3040149 | A1 | 3/2018 |
| CA | 2865338 | C | 6/2019 |
| CA | 2875499 | C | 11/2019 |
| CA | 3030958 | C | 11/2019 |
| CA | 2862209 | C | 1/2020 |
| CA | 2817875 | C | 8/2020 |
| CA | 3031040 | C | 2/2021 |
| CA | 2983574 | C | 11/2021 |
| CN | 106464848 | A | 2/2017 |
| CN | 106574830 | A | 4/2017 |
| CN | 107211109 | A | 9/2017 |
| CN | 108028902 | A | 5/2018 |
| CN | 108369646 | A | 8/2018 |
| CN | 107211109 | B | 10/2018 |
| CN | 106574830 | B | 6/2019 |
| CN | 106464848 | B | 7/2019 |
| CN | 108028902 | B | 5/2021 |
| CN | 108369646 | B | 10/2021 |
| EP | 2609568 | A2 | 7/2013 |
| EP | 2628101 | A1 | 8/2013 |
| EP | 2785424 | A1 | 10/2014 |
| EP | 2804678 | A1 | 11/2014 |
| EP | 2842131 | A1 | 3/2015 |
| EP | 2842131 | A4 | 10/2015 |
| EP | 2785424 | A4 | 12/2015 |
| EP | 2804678 | A4 | 2/2016 |
| EP | 3017598 | A1 | 5/2016 |
| EP | 2842131 | B1 | 11/2016 |
| EP | 3134705 | A1 | 3/2017 |
| EP | 3017598 | A4 | 6/2017 |
| EP | 3222039 | A1 | 9/2017 |
| EP | 2609568 | A4 | 12/2017 |
| EP | 2628101 | A4 | 12/2017 |
| EP | 3134705 | A4 | 12/2017 |
| EP | 3323084 | A1 | 5/2018 |
| EP | 3323240 | A1 | 5/2018 |
| EP | 3222039 | A4 | 7/2018 |
| EP | 2804678 | B1 | 12/2018 |
| EP | 3323240 | A4 | 1/2019 |
| EP | 3134705 | B1 | 6/2019 |
| EP | 3323084 | A4 | 7/2019 |
| EP | 3513356 | A1 | 7/2019 |
| EP | 3710982 | A1 | 9/2020 |
| EP | 2785424 | B1 | 10/2020 |
| EP | 2609568 | B1 | 2/2021 |
| EP | 2609568 | B8 | 3/2021 |
| EP | 2628101 | B1 | 4/2021 |
| EP | 3323240 | B1 | 4/2021 |
| EP | 3222039 | B1 | 5/2021 |
| EP | 3710982 | A4 | 7/2021 |
| JP | 6147446 | A | 5/1994 |
| JP | 06147446 | B1 | 6/2017 |
| JP | 2017518488 | A | 7/2017 |
| JP | 2017521017 | A | 7/2017 |
| JP | 2018504802 | A | 2/2018 |
| JP | 2018523868 | A | 8/2018 |
| JP | 2018530804 | A | 10/2018 |
| JP | 2018504802 | A5 | 1/2019 |
| JP | 2018523868 | A5 | 3/2019 |
| JP | 2018530804 | A5 | 8/2019 |
| JP | 06814196 | B2 | 1/2021 |
| JP | 2021503340 | A | 2/2021 |
| JP | 06858309 | B2 | 4/2021 |
| WO | WO2014144824 | A1 | 9/2014 |

* cited by examiner

SYSTEMS AND METHODS FOR INTEGRATING MEASUREMENTS CAPTURED DURING A GOLF SWING

CROSS REFERENCE TO RELATED APPLICATION

This application is a continuation of U.S. patent application Ser. No. 17/011,678 filed Sep. 3, 2020, which claims priority to U.S. Provisional Patent Application No. 62/897,148 filed Sep. 6, 2019, both of which are incorporated herein by reference in their entirety.

FIELD

This disclosure pertains to, inter alia, measuring, integrating and leveraging measurements captured during a golf swing. More specifically, this disclosure pertains to measuring, integrating and leveraging golf club, golf ball, and golf swing characteristics during a golf swing.

BACKGROUND

Sports enthusiasts may desire to improve their performance through repeated practice and proper equipment fitting. For example, a golfer may hit golf balls on a driving range and/or into a net. The golfer may want to assess each shot to fine-tune performance. Likewise, equipment fitters may also be interested in one or more properties of a golfer's swing and a club's interaction with the golf ball in order to select and fit equipment to the golfer. A launch monitor or other device may be used to assess performance and evaluate a golfer's swing by measuring one or more properties during a golf swing, such as when a golf ball is struck. For example, the launch monitor can be used to measure ball speed, club head speed, launch angle, club path, club face orientation, and other launch and swing properties captured during the golf swing. However, all launch monitors and other devices tend to have limitations based on the technologies used to capture the measurements.

SUMMARY

In an example, a system is provided for integrating golf club and golf ball characteristics captured during a golf swing. The system includes an optical launch monitor configured to capture optical golf club characteristics and optical golf ball characteristics during the golf swing, and a motion sensor configured to capture motion-based golf club characteristics during the golf swing. The system also includes a host computer communicatively coupled to the optical launch monitor and the motion sensor. The host computer is configured to receive the motion-based golf club characteristics from the motion sensor, and to receive the optical golf club characteristics and the optical golf ball characteristics from the optical launch monitor. The host computer is also configured to select a subset of characteristics from the optical golf club characteristics, the optical golf ball characteristics, and the motion-based golf club characteristics, and to combine the subset of characteristics into an integrated set of golf club and golf ball characteristics. The host computer is further configured to provide the integrated golf club and golf ball characteristics for display to a user. The host computer may also provide a recommendation to the user, such as a club fitting or swing technique recommendation.

In another example, a method is provided for integrating golf club and golf ball characteristics captured during a golf swing. For example, the method receives golf club characteristics captured during the golf swing from a golf club sensor, receives golf ball characteristics captured during the golf swing from a golf ball launch monitor, and integrates the received golf club and golf ball characteristics. For example, integrating the received golf club and golf ball characteristics may include selecting a subset of golf club characteristics from the received golf club from the golf club sensor and the golf ball launch monitor. The method may further transmit the integrated golf club and golf ball characteristics to a user device, and may recommend a golf club or a swing technique based on the integrated golf club and golf ball characteristics.

In a further example, another system is for integrating golf club and golf ball characteristics captured during a golf swing. For example, the system includes a server computer communicably coupled to one or more input sources and to one or more user interface devices. In this embodiment, the server computer is configured to receive golf club characteristics captured during the golf swing from the one or more input sources, to receive golf ball characteristics captured during the golf swing from the one or more input sources, and to store the received golf club and golf ball characteristics. The server computer is further configured to select a subset of received golf club and golf ball characteristics, and to transmit the selected subset of received golf club and golf ball characteristics to the one or more user devices.

The foregoing and other objects, features, and advantages of the invention will become more apparent from the following detailed description, which proceeds with reference to the accompanying figures.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
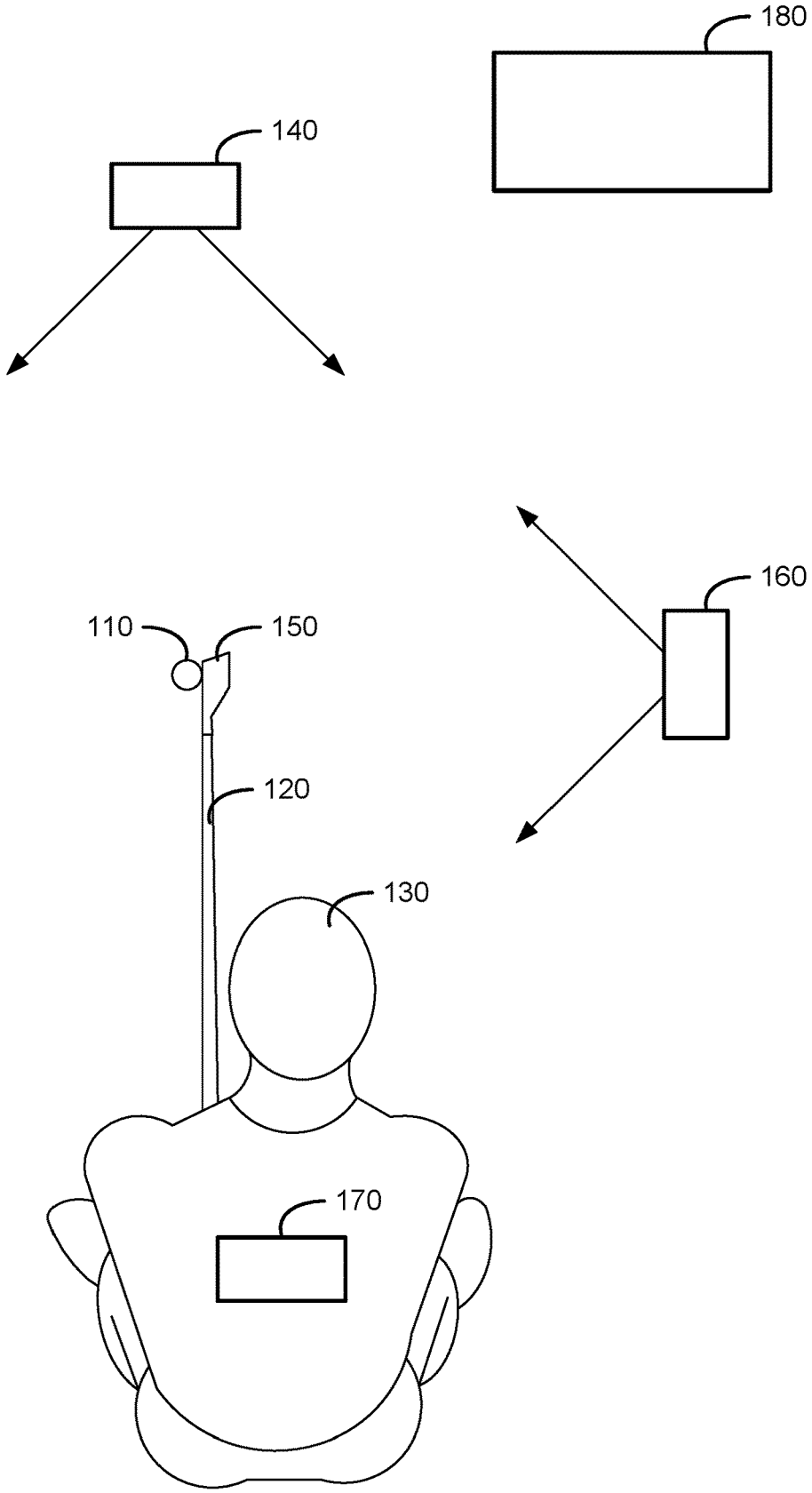
FIG. 1 is a system diagram of an exemplary system in accordance with one or more of the present embodiments.

Disclosed are various systems and methods for capturing, integrating and leveraging measurements captured during a golf swing, such as golf club, golf ball, and golf swing characteristics during a golf swing. It would be understood by one of skill in the art that the disclosed systems and methods are described in but a few exemplary embodiments among many. No particular terminology or description should be considered limiting on the disclosure or the scope of any claims issuing therefrom.

The sport of golf is fraught with many challenges. Enjoyment of the game is increased by addressing the need to hit the golf ball further, straighter, and with more skill. As one progresses in golfing ability, the ability to compete at golf becomes a source of enjoyment. However, one does not simply hit a golf ball straighter or further by mere desire. Like most things, skill is increased with practice—be it repetition or instruction so that certain elements of the game become easier over time. But it may also be possible to improve one's level of play through the use of technology.

The present embodiments provide systems and methods for aggregating measurements captured by different technologies during a golf swing. By capturing measurements using different technologies, more accurate measurements may be provided to a user by selecting from the measurements, offsetting measurements based on the technologies used, and aligning measurements from different devices. Further, by aggregating measurements received from different devices, additional features and functionalities may be provided to the user absent from any of the devices when used alone. Additionally, by aggregating and storing the measurements, golfers, club fitters, instructors, and other users may access and leverage larger databases of measurements to better understand the user's golf swing and to provide better recommendations to the user. For example, by storing the measurements in a cloud server, the aggregated measurements may be accessible by a variety of different user devices and software applications. The aggregated measurements may be utilized to better understand the captured data, such as to provide for more accurate trajectory models, roll models, algorithms interpreting data and images to accurately depict a shot, developing an artificial turf that replicates real grass club interaction and ball roll, and other algorithms and models used to analyze or simulate a golf shot and/or swing.

Exemplary Launch Monitors, Sensors, and Other Input Sources

Many different technologies have been applied to the problem of capturing measurements during a golf swing. Because of the limitations of the different technologies, as well as budgetary limitations in choosing system components, manufacturers often design systems with different strengths and weaknesses. One or more of the present embodiments may overcome the limitations of any one device by concurrently capturing measurements using different technologies, allowing the measurements of multiple devices to be aggregated and leveraged to present more accurate measurements to the user and to provide additional functionalities based on the aggregated measurements. For example, by capturing measurements concurrently with multiple devices, the most accurate measurements from the different devices may be presented to the user.

One such device is a launch monitor. Launch monitors, which may be placed behind, beside, above, or in another location with respect to a golf ball, provide a system of one or more sensors that capture measurements during a golf swing. For example, launch monitors may capture a number of measurements based on monitoring the golf ball, the golf club, the golfer, or a combination thereof. For example, launch monitors often measure ball speed, club head speed, launch angle, spin, club path, ball path, carry distance, total distance, shot dispersion, and other measurements. Further, launch monitors may also calculate additional measurements, such as smash factor, which is calculated from ball speed and club head speed measurements.

Some launch monitors use high speed cameras to capture measurements during a golf swing. Camera-based launch monitors are often referred to as optical launch monitors, and may use multiple cameras to capture the measurements during the golf swing. Multi-camera systems may measure the golf ball, the golf club, or a combination thereof. For example, GC Quad by Foresight Sports uses four cameras (i.e., quadrascopic) to capture measurements of the golf ball and the golf club during the golf swing. Other optical systems, such as GC2 by Foresight Sports, use fewer cameras, such as only two cameras (i.e., stereoscopic), and only capture measurements of the golf ball. Additional sensors may be provided to capture additional measurements, such as by providing additional cameras to capture golf club measurements (e.g., adding HMT (head measurement technology) by Foresight Sports to the GC2 launch monitor). During use, optical launch monitors are typically placed beside the golf ball before the golf swing.

Launch monitors may also use radar technology, such as Doppler radar, to capture measurements during a golf swing. Radar-based launch monitors are often referred to as Doppler or radar launch monitors. Radar launch monitors may use multiple radar systems to measure the golf ball, the golf club, or a combination thereof. For example, Trackman 4 by TrackMan Golf uses two radar systems (i.e., dual radar technology), with one radar system tracking movement of the golf club and one radar system tracking movement of the golf ball. During use, Doppler launch monitors are typically placed behind the golf ball before the golf swing.

Additional sensors may also be used by launch monitors to provide greater accuracy, such as using barometers to measure altitude information for generating more accurate calculations based on the optical or radar measurements. Additional sensors may also be incorporated into launch monitors, such as to capture additional measurements and/or to increase the accuracy of calculated metrics.

The different launch monitor technologies each have advantages and disadvantages with respect to each other. For example, optical launch monitors typically offer good measurements on the golf club head (i.e., face to path, dynamic loft and other metrics) and good ball measurements (i.e., spin and other metrics). However, optical launch monitors base their measurements on the initial launch parameters of the ball (i.e., captured during the first few feet the golf ball travels) and cannot follow the entire path of the golf ball. Therefore, optical launch monitors may be less accurate in carry distance, total distance, and other measurements because these measurements must be calculated based on the initial launch parameters. Further, some optical launch monitors require stickers to be placed on the club head in order to accurately measure the club head, and may provide inaccurate measurements without the stickers being present.

Radar launch monitors may have a different set of advantages and disadvantages. For example, radar launch monitors typically offer good golf ball measurements, but may be less accurate with respect the golf club measurements. Radar launch monitors may provide accurate carry distance, total distance, and other measurements because the ball can be tracked through its entire flight. However, other ball measurements may be less accurate using a radar launch monitor. For example, some radar launch monitors estimate spin measurements based on the curvature of a golf ball during flight. However, on a windy day, for example, radar launch monitors may provide inaccurate side spin numbers. Therefore, optical launch monitors are typically superior for spin measurements because the measurements are captured directly, rather than estimated based on ball flight.

The relative advantages and disadvantages between different launch monitors may also differ depending on whether the launch monitors are used indoors or outdoors. For example, when used outdoors, radar launch monitors can follow the entire flight of the ball, capturing accurate measurements of carry and total distance. However, when used indoors, radar launch monitors must calculate carry and total distance based on initial launch parameters in the same manner as optical launch monitors. Accordingly, when used outdoors, radar launch monitors may provide more accurate carry and total distance measurements. Further, because optical launch monitors rely on algorithms to calculate carry and total distance when used outdoors, calibration of the launch monitor may be especially important. For example, most optical launch monitors are used in a "normalized" mode, which estimates carry and total distance based on a set of assumed or ideal course conditions (i.e., sea level, 75 degrees, no wind, etc.). As such, optical launch monitors may provide carry and total distance irrespective of course conditions, leading to greater inaccuracies. When used indoors, radar and optical launch monitors may provide similarly accurate carry and total distance measurements, limited primarily on the algorithms used by each system.

In another example, radar launch monitors may provide less accurate spin measurements when used outdoors. As discussed above, many radar launch monitors estimate spin based on ball flight curvature, which may be adversely affected by wind conditions outdoors (e.g., under- or over-estimating spin when a strong cross-wind is present). Optical launch monitors do not often suffer from the adverse effects of wind conditions because the optical launch monitors measure spin directly, rather than by estimation.

Mobile devices and other personal computing devices may use the device's camera to provide a personal launch monitor. For example, personal launch monitors are described in more detail in U.S. Provisional Patent Appl. No. 62/168,225, filed May 29, 2015, and in U.S. Pat. Nos. 9,697,613 and 10,223,797 to Tofolo, et. al, entitled "LAUNCH MONITOR," which are hereby incorporated by reference herein in their entirety. For example, a launch monitor is disclosed having a camera that can be used to measure a trajectory parameter of a golf ball using a low-speed and a high-speed mode of the camera. Personal launch monitors may provide for ball speed, spin, club head speed, and other metrics. Other personal launch monitors may include the Swing Caddie SC300 by Voice Caddie, the SkyTrak launch monitor, Earnest launch monitors, and other launch monitors.

In addition to launch monitors, additional sensors and input devices may be used to measure the golfer, the golf ball or the golf club during a golf swing. For example, three-dimensional (3D) motion may be measured during the golf swing. The Gears system by Gears Sports is an optical motion capture system that utilizes optical markers placed on the golf club and/or golfer. For example, reflective markers may be placed on the butt end of the golf club grip to capture grip data, on the golf club head to capture head data, and on the golfer to capture additional measurements. High speed cameras are then used to capture motion data base on how the markers move during the golf swing. This motion data may indicate a forward lean of the club shaft at impact, swing tempo, ball initial launch parameters, face angle, club path, and other metrics.

Other types of motion sensors may also be used. For example, Blast by Blast Motion uses a three-axis gyro sensor and an accelerometer to capture golf club movement during a golf swing. The Blast sensor mounts to the butt end of the golf club grip, and provides metrics on forward shaft lean at impact, swing tempo, ball initial launch parameters, face angle and other metrics. Body motion sensors may also be provided, such as K-vest by K-Motion Interactive, Inc., which uses a vest and belt system for capturing and providing measurement of the golfer's shoulders and hips during the golf swing, such as tempo, body positions, wrist angles, peak swing speeds and swing sequencing.

Sensors may also be provided in the golf ball. For example, sensors in the golf ball may include motion sensor, global positioning system (GPS) sensors and/or other sensors to capture measurements of the golf ball, such as spin, total distance, and putting metrics. In another example, the GENiUS ball by OnCore includes an embedded chipset with GPS location and shot data including spin rate, trajectory, velocity, and other data. Golf balls with embedded sensors may be paired with a mobile or desktop application to display the shot data and initial parameters paired with GPS, and analytics using the data and parameters. With respect to the GENiUS ball, a mobile device application may show the ball's location on the course, ball velocity, spin rate and spin axis, carry distance and roll, distance from the green and other metrics. The golf ball may also be tagged and coded for identification, such as using an RFID tag or another technology.

Video has also been long used to evaluate the golf swing, and many technologies integrate optical systems capable of capturing video. For example, some launch monitors combine optical and radar technologies, such as X3 by FlightScope Ltd. which combines 3D tracking radar with image processing, providing video of the golf swing alongside measurements captured during the swing. Other systems time stamp or clip video streams based on other sensor measurements, such that the user is able to evaluate video of a golf swing alongside other swing measurements. High frame rate cameras may also be used in conjunction with other data acquisition devices, such as a High Speed Phantom Camera capable of capturing up to 12,500 frames per second (fps) or more. Additionally, high speed camera systems with an accompanying image processing system have been provided for specialized applications. For example, Quintic Ball Roll and PuttView are camera systems that capture high speed images of a golfer's putting stroke and display putting metrics and recommendations based on processing the high speed images.

Adjustable and/or instrumented surfaces may also be used to capture additional metrics. For example, pressure plates, such as by Swing Catalyst, provide metrics on how the golfer interacts with the ground. Further, the pressure plates may show how the golfer transfers her weight during the swing, which may be indicative of early extensions, rotation, and other characteristics of the golf swing. Adjustable and non-adjustable surfaces may also be used to simulate different lies on the golf course. For example, Perfection Platforms provides an adjustable planar putting and full swing practice surfaces that simulate green undulations that cause putts to curve and uneven lies that cause balls to curve when hit. In another example, FiberBuilt mats provide for an artificial turf that replicates real grass club interaction and ball roll. Artificial turf providing for accurate club-turf interaction may be provided as a fitting mat, such as to replace a fitting lie board that is typically used to determine lie angles of the golf club by striking a golf ball on the lie board and observing a pattern left on a sticker affixed to the sole of a golf club. A fitting mat, in conjunction with a launch monitor, club sensors, and/or high-speed cameras may provide for more accurate fitting and club metrics.

Global positioning system (GPS) sensors may be used to track golf shots during play, aggregate golf club distance data, and provide recommendations to the user. For example, Arccos Caddie Smart Sensors by Arccos Golf provides for a GPS-based hardware and software system for automatically recording golf shots during a round. In this example, each club is provided with a unique sensor and tag, and using the GPS coordinates provided by an accompanying device (e.g., a smart phone), each golf shot is recorded as well as the distance between shots. The Arccos Caddie Smart Sensors and system use a combination of optical and auditory sensors to capture club and shot data. To save power between shots, an ambient light sensor is used to power on an auditory system, such as when a club/sensor is pulled from a bag. The auditory system includes microphone in the sensor that communicates with a receiver in a mobile phone or another device, such as a mobile phone in the golfer's pocket. A standalone device may be provided to receive the signals and to provide GPS coordinates, and a standalone device may provide for more accurate GPS coordinates than a mobile phone. The microphone in the sensor is configured to send two signals at difference frequencies. A first signal in the range of 17.4 kHz to 18.6 kHz is sent as a club identifier when a club is in an address position. A second signal in the range of 18.4 kHz to 19.8 kHz is then sent when the ball is struck. A GPS coordinate is tagged based on the second signal, and distance data is calculated from the tagged GPS coordinates and is associated with the identified club. The golfer's tendencies can also be leveraged from the GPS coordinates, such as whether a golfer typically misses right, short, long, etc. Other systems capture similar information, such as using radio-frequency identification (RFID) or another type of tags or requiring that the information to be entered manually. myRoundPro by TaylorMade Golf includes a smart phone application for logging golf shots during a round using GPS coordinates.

Smart bands, watches, and other wearable devices may also communicate with club tags to provide functionalities as discussed herein.

By understanding the limitations of each type of technology, the present embodiments may select the most accurate measurements and/or calculated metrics to present to a user. Further, as additional technologies and input devices are introduced to capture measurements of the golf swing, the additional technologies may be evaluated and integrated using the present embodiments to increase the accuracy measurements provided to a user.

Exemplary Systems

FIG. 1 is a system diagram depicting an exemplary system 100 for integrating golf ball characteristics, golf club characteristics, and/or golfer characteristics captured during a golf swing. The system 100 includes two or more devices for capturing measurements of the golf ball 110, the golf club 120, and/or the golfer 130 during a golf swing. For example, the system 100 may include an optical launch monitor 140 for capturing optical golf club characteristics and optical golf ball characteristics during the golf swing. The system 100 may also include a motion sensor 150 for capturing motion-based golf club characteristics during the golf swing. The motion sensor 150 may be coupled to the golf club 120 at any point, such as at the club head (as pictured), in a butt end of the grip, or at another location on the golf club 120. The system 100 may also include a radar launch monitor for capturing radar golf club characteristics and radar golf ball characteristics during the golf swing. Additional, different, and fewer sensors may be provided for capturing additional measurements during the golf swing, such as a motion sensor 170 for measuring movement by the golfer 130 during the golf swing. Additionally, wireless sensors, such as Bluetooth, RFID, or other sensors, may be used to identify the golf club 120, or components (e.g., head, shaft, grip, or another club component) and/or specifications (e.g., length, loft, lie, adapter settings, or another club specification) thereof.

The system 100 also includes a host computer 180 communicatively coupled to the sensors in the system 100. The host computer 180 can be any of a variety of computing devices (e.g., personal computer (PC), laptop computer, tablet, smart phone, cell phone, smartphone, Personal Digital Assistant (PDA), server computer, or another computing device). The host computer 180 may be communicatively coupled to one or more of the optical launch monitor 140, the motion sensor 150, the radar launch monitor 160 and/or the motion sensor 170. The host computer 180 may be communicatively coupled to the sensors using any known or unknown wired or wireless communication method, such as Universal Serial Bus (USB), Bluetooth, Wi-Fi, or another communication protocol. Multiple different communication protocols may be used concurrently. For example, the motion sensor 150 may communicate with Bluetooth while the optical launch monitor may communicate with Wi-Fi.

The host computer 180 is configured to receive golf club measurements from the different sensors and to integrate the measurements for presentation to the golfer 130 or another user, such as an instructor or club fitter. The received golf club measurements may be stored before or after integration, such as in a database of measurements associated with the golfer. In an example, the host computer 180 is configured receive the optical golf club characteristics and the optical golf ball characteristics from the optical launch monitor 140 and to receive motion-based golf club characteristics from the motion sensor 150. The host computer 180 then selects a subset of the received characteristics and combines the selected subset characteristics into an integrated set of golf club and golf ball characteristics for presentation to the golfer 130. The integrated set of golf club and golf ball characteristics may also be stored in a database and associated with a user profile for the golfer 130.

The host computer 180 may select the subset of characteristics based on an accuracy metric or another criteria for each of the optical golf club characteristics, each of the optical golf ball characteristics, and each of the motion-based golf club characteristics. As discussed above, each sensor technology may have different strengths and weaknesses, and may provide measurements with different levels of accuracy. Based on the strengths and weaknesses of each sensor technology, the host computer 180 may assign an accuracy metric to each measurement captured by each sensor. In this example, when multiple sensors provide the same or a similar measurement, the host computer 180 may select the sensor measurement with the highest accuracy metric.

The host computer 180 may also be configured to combine the subset of characteristics by applying a correction coefficient. For example, different sensors may provide slightly different outputs for the same measurement. For example, optical and radar launch monitors may provide different outputs for the same angle of attack measurements, with the outputs differing by about 1.5 degrees. If the host computer 180 receives a measurement from a sensor with an output that is known to be inaccurate, the host computer 180 may apply a correction coefficient to the output, allowing the host computer 180 to present an adjusted measurement to the user. Further by correcting measurements between devices, the user may be provided with consistent measurements irrespective of what device was used to capture the measurements.

The host computer 180 may be configured to provide the integrated golf club and golf ball characteristics for display to a user. The host computer 180 may also provide a recommendation for display to a user, such as a golf club fitting recommendation, a golf swing technique recommendation, or another recommendation.

In an embodiment, the system 100 may operate as a "universal remote" for multiple launch monitors and other sensor devices. For example, system 100 may be coupled to both the optical launch monitor 140 and the radar launch monitor 160. In this example, many of the same measurements are captured by both launch monitors. During operation, both launch monitors operate side-by-side, and transmit measurements to the host computer 180 concurrently. The host computer 180 receives the measurements from both launch monitors and displays only the most accurate measurements from the two launch monitors. In this example, priority is given to different measurements captured by the launch monitors based on the technology, based on whether the measurements were captured indoors or outdoors, based on the settings and calibration used by of each launch monitor, and based on other criteria affecting accuracy of the launch monitors. By giving priority to measurements captured by the different launch monitors, the system 100 may handle issues with each launch monitor and provide more accurate and usable data to the user. Further, the measurements captured by each launch monitor may be stored with time stamps, recorded with any offsets applied to one or more of the measurements, and recorded with the priority given to each measurement.

In another embodiment, the host computer may apply offsets to measurements captured by misaligned launch monitors and other sensors. For example, if a launch monitor is misaligned, the launch monitor may indicate that a golf shot that is off-line with respect to the intended target line, when in reality, the user may have failed to place and calibrate the launch monitor properly. In this example, the system 100 may be coupled to optical launch monitor 140 and radar launch monitor 160. By concurrently capturing measurements using the different launch monitors, offsets can be applied to measurements captured by a misaligned launch monitor based on measurements received from the other launch monitor. In some embodiments, one type of launch monitor may be more easily configured and accurately placed (i.e., using a camera, an optical alignment stick, or another method). By relying on the easily configured and more accurately placed launch monitor as a baseline, measurements captured by the other launch monitor can be offset and corrected, such as start line, dispersion, club face angle and other measurements. In another embodiment, measurements from the other launch monitor are disregarded as inaccurate and only measurements from the easily configured and more accurately placed launch monitor are selected for display to the user.

Figure 2:
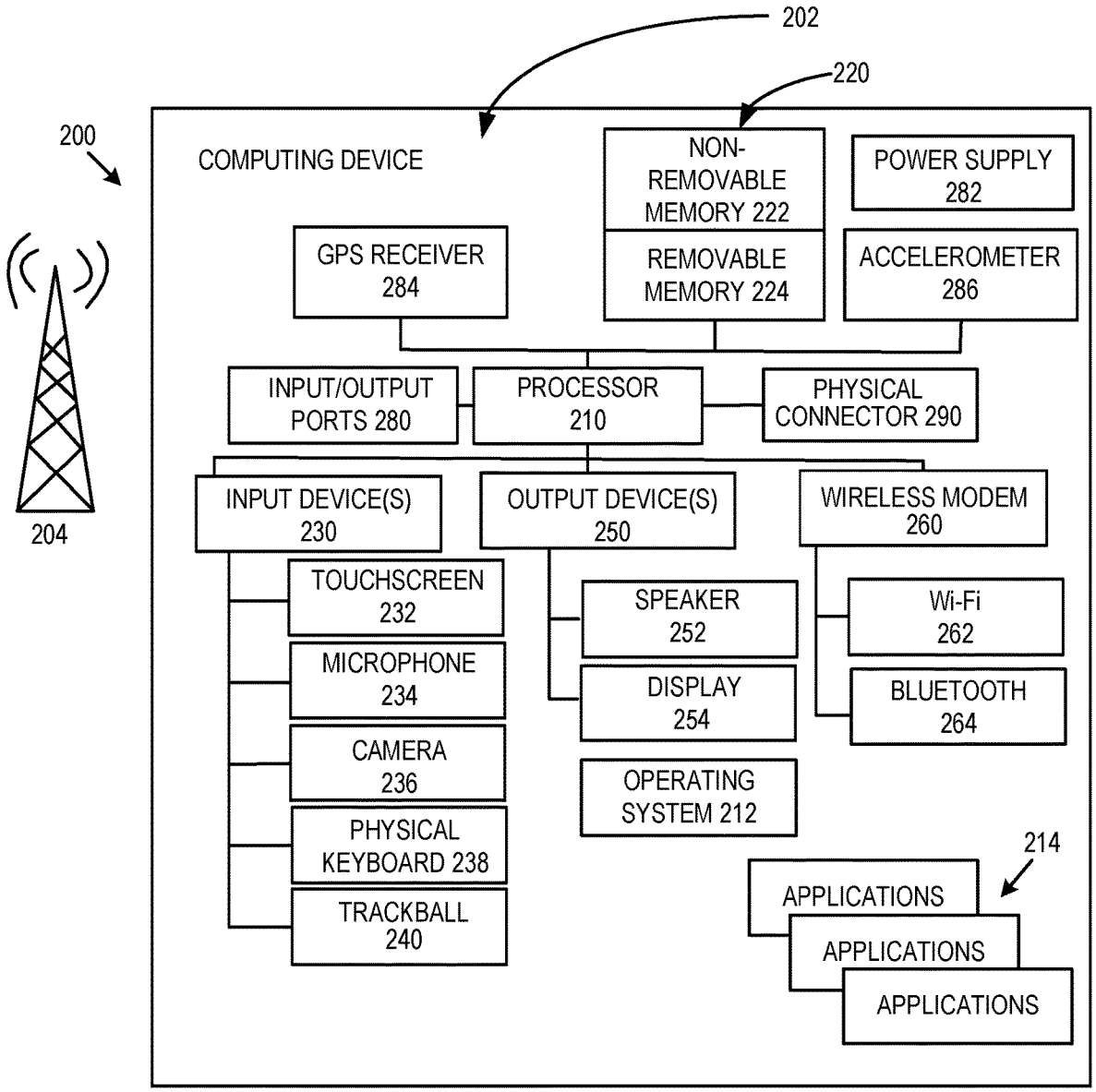
FIG. 2 is a system diagram of an exemplary computing device in accordance with one or more of the present embodiments.

As discussed above, the host computer 180 can be any of a variety of computing devices. FIG. 2 is a system diagram of an exemplary computing device in accordance with one or more of the present embodiments. The computing device 200 may include a variety of optional hardware and software components, shown generally at 202. The computing device 200 can be a multi-function device that includes software applications for providing functionality to one or more of the launch monitors and/or other sensors. The launch monitor and/or sensor functionality can be pre-loaded on the computing device 200 or can be downloaded from an app store, for example.

Any components 202 in the computing device 200 can communicate with any other component, although not all connections are shown, for ease of illustration. The computing device 200 can be any of a variety of computing devices (e.g., personal computer (PC), laptop computer, tablet, smart phone, cell phone, smartphone, Personal Digital Assistant (PDA), server computer, or another computing device) and can allow wireless two-way communications with one or more mobile communications networks 204, such as a Wi-Fi, Bluetooth, cellular, satellite, or another network.

The illustrated computing device 200 can include a controller or processor 210 (e.g., signal processor, microprocessor, ASIC, or other control and processing logic circuitry) for performing such tasks as signal coding, data processing, input/output processing, power control, and/or other functions. An operating system 212 can control the allocation and usage of the components 202 and support for one or more application programs 214. The application programs can include a launch monitors and/or other sensors, common mobile computing applications (e.g., email applications, calendars, contact managers, web browsers, messaging applications), or any other computing application. The operating system 212 can include drivers and/or other functionality for controlling and accessing one or more input devices 230 and one or more output devices 250. For example, the operating system 212 can include functionality for the host computer 180.

The illustrated computing device 200 can include memory 220. The memory 220 can include non-removable memory 222 and/or removable memory 224. The non-removable memory 222 can include RAM, ROM, flash memory, a hard disk, or other well-known memory storage technologies. The removable memory 224 can include flash memory or a Subscriber Identity Module (SIM) card, which is well known in GSM communication systems, or other well-known memory storage technologies, such as "smart cards." The memory 220 can be used for storing data and/or code for running the operating system 212 and the applications 214. Example data can include web pages, text, images, sound files, video data, or other data sets to be sent to and/or received from one or more network servers or other devices via one or more wired or wireless networks. The memory 220 can be used to store a subscriber identifier, such as an International Mobile Subscriber Identity (IMSI), and an equipment identifier, such as an International Mobile Equipment Identifier (IMEI). Such identifiers can be transmitted to a network server to identify users and equipment.

The computing device 200 can support one or more input devices 230, such as a touchscreen 232, microphone 234, camera 236, physical keyboard 238 and/or trackball 240. The computing device 200 can support one or more output devices 250, such as a speaker 252 and a display 254. Other possible output devices (not shown) can include piezoelectric or other haptic output devices. Some devices can serve more than one input/output function. For example, touchscreen 232 and display 254 can be combined in a single input/output device. The input devices 230 can include a Natural User Interface (NUI). An NUI is any interface technology that enables a user to interact with a device in a "natural" manner, free from artificial constraints imposed by input devices such as mice, keyboards, remote controls, and the like. Examples of NUI methods include those relying on speech recognition, touch and stylus recognition, gesture recognition both on screen and adjacent to the screen, air gestures, head and eye tracking, voice and speech, vision, touch, gestures, and machine intelligence. Other examples of a NUI include motion gesture detection using accelerometers/gyroscopes, facial recognition, 3D displays, head, eye, and gaze tracking, immersive augmented reality and virtual reality systems, all of which may provide a more natural interface. Thus, in one specific example, the operating system 212 or applications 214 can comprise speech-recognition software as part of a voice user interface that allows a user to operate the device 200 via voice commands. Further, the device 200 can comprise input devices and software that allows for user interaction via a user's spatial gestures, such as detecting and interpreting gestures to provide input to a gaming application.

A wireless modem 260 can be coupled to an antenna (not shown) and can support two-way communications between the processor 210 and external devices, as is well understood in the art. For example, the external devices can be server computers, wearable devices (such as a Bluetooth headset or a watch), or additional output devices. The modem 260 is shown generically and can include a cellular modem for communicating with the mobile communication network 204 and/or other radio-based modems (e.g., Bluetooth 264 or Wi-Fi 262). The wireless modem 260 is typically configured for communication with one or more cellular networks, such as a GSM network for data and voice communications within a single cellular network, between cellular networks, or between the computing device and a public switched telephone network (PSTN).

The computing device can further include at least one input/output port 280, a power supply 282, a satellite navigation system receiver 284, such as a Global Positioning System (GPS) receiver, an accelerometer 286, and/or a physical connector 290, which can be a USB port, IEEE 1394 (FireWire) port, and/or RS-232 port. The illustrated components 202 are not required or all-inclusive, as any components can be deleted and other components can be added.

Figure 3:
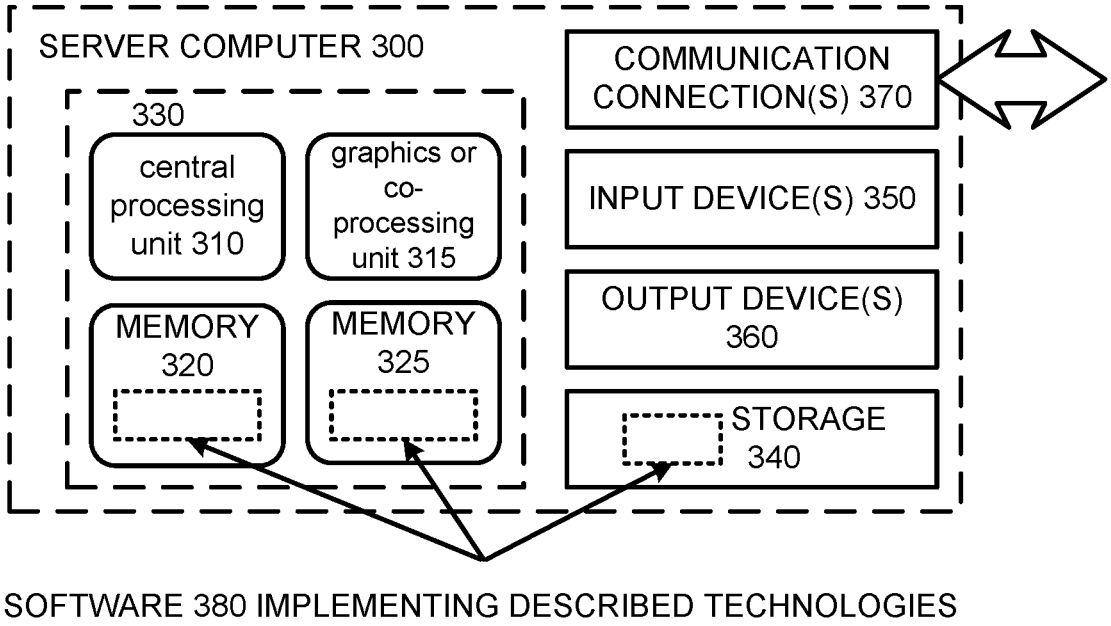
FIG. 3 is an exemplary a system diagram of an exemplary server computer of one or more of the present embodiments.

In one or more embodiments, a server computer is provided for integrating data and measurements captured during a golf swing. For example, FIG. 3 depicts a generalized example of a suitable server computer 300 in which the described innovations may be implemented. The server computer 300 is not intended to suggest any limitation as to scope of use or functionality, as the innovations may be implemented in diverse general-purpose or special-purpose computing systems. For example, the server computer 300 can be any of a variety of computing devices (e.g., desktop computer, laptop computer, server computer, tablet computer, media player, gaming system, mobile device, or another computing device)

With reference to FIG. 3, the server computer 300 includes one or more processing units 310, 315 and memory 320, 325. In FIG. 3, this basic configuration 330 is included within a dashed line. The processing units 310, 315 execute computer-executable instructions. A processing unit can be a general-purpose central processing unit (CPU), processor in an application-specific integrated circuit (ASIC) or any other type of processor. In a multi-processing system, multiple processing units execute computer-executable instructions to increase processing power. For example, FIG. 3 shows a central processing unit 310 as well as a graphics processing unit or co-processing unit 315. The tangible memory 320, 325 may be volatile memory (e.g., registers, cache, RAM), non-volatile memory (e.g., ROM, EEPROM, flash memory, etc.), or some combination of the two, accessible by the processing unit(s). The memory 320, 325 stores software 380 implementing one or more innovations described herein, in the form of computer-executable instructions suitable for execution by the processing unit(s).

A computing system may have additional features. For example, the server computer 300 includes storage 340, one or more input devices 350, one or more output devices 360, and one or more communication connections 370. An interconnection mechanism (not shown) such as a bus, controller, or network interconnects the components of the server computer 300. Typically, operating system software (not shown) provides an operating environment for other software executing in the server computer 300, and coordinates activities of the components of the server computer 300.

The tangible storage 340 may be removable or non-removable, and includes magnetic disks, magnetic tapes or cassettes, CD-ROMs, DVDs, or any other medium which can be used to store information in a non-transitory way and which can be accessed within the server computer 300. The storage 340 stores instructions for the software 380 implementing one or more innovations described herein. The storage 340 also stores data captured during a golf swing, such as in a database or another file structure.

The input device(s) 350 may be a touch input device such as a keyboard, mouse, pen, or trackball, a voice input device, a scanning device, or another device that provides input to the server computer 300. For video encoding, the input device(s) 350 may be a camera, video card, TV tuner card, or similar device that accepts video input in analog or digital form, or another storage medium that provides video samples into the server computer 300. The output device(s) 360 may be a display, printer, speaker, or another device that provides output from the server computer 300.

The communication connection(s) 370 enable communication over a communication medium to another computing entity. The communication medium conveys information such as computer-executable instructions, audio or video input or output, or other data in a modulated data signal. A modulated data signal is a signal that has one or more of its characteristics set or changed in such a manner as to encode information in the signal. By way of example, and not limitation, communication media can use an electrical, optical, RF, or other carrier.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods.

Any of the disclosed methods can be implemented as computer-executable instructions stored on one or more computer-readable storage media (e.g., one or more optical media discs, volatile memory components (such as DRAM or SRAM), or nonvolatile memory components (such as flash memory or hard drives)) and executed on a computer (e.g., any commercially available computer, including smart phones or other mobile devices that include computing hardware). The term computer-readable storage media does not include communication connections, such as signals and carrier waves. Any of the computer-executable instructions for implementing the disclosed techniques as well as any data created and used during implementation of the disclosed embodiments can be stored on one or more computer-readable storage media. The computer-executable instructions can be part of, for example, a dedicated software application or a software application that is accessed or downloaded via a web browser or other software application (such as a remote computing application). Such software can be executed, for example, on a single local computer (e.g., any suitable commercially available computer) or in a network environment (e.g., via the Internet, a wide-area network, a local-area network, a client-server network (such as a cloud computing network), or other such network) using one or more network computers.

For clarity, only certain selected aspects of the software-based implementations are described. Other details that are well known in the art are omitted. For example, it should be understood that the disclosed technology is not limited to any specific computer language or program. For instance, the disclosed technology can be implemented by software written in C++, Java, Perl, JavaScript, Adobe Flash, or any other suitable programming language. Likewise, the disclosed technology is not limited to any particular computer or type of hardware. Certain details of suitable computers and hardware are well known and need not be set forth in detail in this disclosure.

It should also be well understood that any functionality described herein can be performed, at least in part, by one or more hardware logic components, instead of software. For example, and without limitation, illustrative types of hardware logic components that can be used include Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), etc.

Furthermore, any of the software-based embodiments (comprising, for example, computer-executable instructions for causing a computer to perform any of the disclosed methods) can be uploaded, downloaded, or remotely accessed through a suitable communication means. Such suitable communication means include, for example, the Internet, the World Wide Web, an intranet, software applications, cable (including fiber optic cable), magnetic communications, electromagnetic communications (including RF, microwave, and infrared communications), electronic communications, or other such communication means.

With reference to FIG. 3, server computer 300 is provided as part of a system configured to integrate data captured during a golf swing. Server computer 300 is communicably coupled to one or more input sources and to one or more user interface devices. For example, the one or more input sources may be an optical launch monitor, a radar launch monitor, a motion sensor, a video camera, or another sensor for capturing data during a golf swing. The one or more user interface devices may include a user workstation, tablet, smart phone, personal computer (PC), or another user interface device. In one or more embodiments, one of the input sources is a video camera of the user interface device, such as a smart phone camera.

The server computer 300 is configured to receive data from the one or more input sources and to store the received data. For example, the server computer 300 may receive data captured by the input sources via the communication connection(s) 370. After receiving the data, the server computer 300 may store the data, such as in a database in storage 340. The server computer 300 may also be configured to select a subset of the received data, such as prior to storing the data and/or prior to transmitting the integrated data to a user interface device.

The server computer 300 may be provided as a cloud implementation, with the stored data accessible via the internet or another network. For example, the cloud implementation may provide a "data locker in the cloud," allowing users to store and access data captured by the one or more input devices via one or more user interface devices. In one or more embodiments, a user may access the cloud server in real-time, such as using a mobile application, internet browser or other software.

In some embodiments, the cloud server provides access to stored data as a subscription service, such as a service accessible by one or more mobile application, internet browser or other software. The cloud server may suggest swing tips, instructional videos, and other recommendations based on analyzing the received data, by identifying swing flaws, identifying tendencies, and by providing other data analytics. The cloud server may also provide club selection and distance recommendations for the user based on the user's data and launch conditions. Further, the server may also provide club fitting recommendations, such a recommending a club to fill a distance gap in the user's equipment, suggesting loft, lie, flex and other club characteristics for new equipment, and even suggesting a different style of golf club based on the user's swing (e.g., recommending a user switch from a toe hang style of putter to a face balanced putter based on the user's putting stroke, recommending a golfer switch from a blade type iron to a cavity back or game improvement iron, or another recommendation).

In some embodiments, the cloud server integrates data to and from other data tracking platforms, such as myRound-Pro by TaylorMade Golf, Arccos Golf, or another platform. In various embodiments, the cloud server accesses and stores the data provided from the other data tracking platforms. The server computer may also provide new functionality to the other data tracking platforms. For example, the cloud server may provide updated data for calibrating a user's Arccos Golf platform. Arccos Golf and other platforms often require the user to log a minimum number of rounds of golf in order for the platforms to learn the user's distances, tendencies and provide full access to the platform's features. Arccos Golf, for instance, may require the user to log five rounds before the Arccos caddie begins providing club selections, course management recommendations, odds for making birdie, par, bogie, or another score based on a club selected, and other features. However, if a user makes a swing change (e.g., after taking a golf lessons or suffering an injury, purchases new equipment, etc.), the Arccos Golf platform will no longer be accurate for the user. Instead of requiring the user to log another five rounds of golf to relearn the user's data, the cloud server may leverage data captured by a launch monitor or other sensor to provide new data to the Arccos platform. In this example, a single driving range session can be used to recalibrate the Arccos platform, such as having the user hit ten shots with a 4-iron on a launch monitor for use in updating the user's profile in the Arccos platform. A new Arcoos user may also bypass the learning stage by relying solely on launch monitor data to access the features of the Arccos caddie. Additional and different platforms may be integrated with the cloud server.

In an embodiment, a method is provided for calibrating a golf tracking application. For example, the golf tracking application is initialized for the user's equipment, such as by allowing the user to enter the specifications of each golf club. The golf club specifications may include identify each club associated with the loft of the club. Other specifications may also be included. Next, initial launch parameters are captured for the user, such as using a single club, a subset of golf clubs, or using each golf club. A predetermined number of shots may be captured the user and/or golf club(s). The initial launch parameters and/or other user data may be captured by a launch monitor, a motion sensor, a video camera, an instrumented ball, or by another data acquisition device. The initial launch parameters and/or other user data may include carry distance, spin, launch angle and dispersion. Extrapolated user data is then generated based on the initial launch parameters and/or other data. For example, by hitting a predetermined number of shots with a specific club, the application can be calibrated for the user's other golf clubs, such as auto-populating estimated carry distances for the user's other golf clubs. Finally, the golf application is calibrated using the extrapolated user data. Additional or different acts may be provided. For example, a playing recommendation may be provided to the user using the calibrated golf tracking application. The playing recommendation may include a club selection, odds for making par based on a club selection, or another recommendation.

Exemplary Methods

Figure 4:
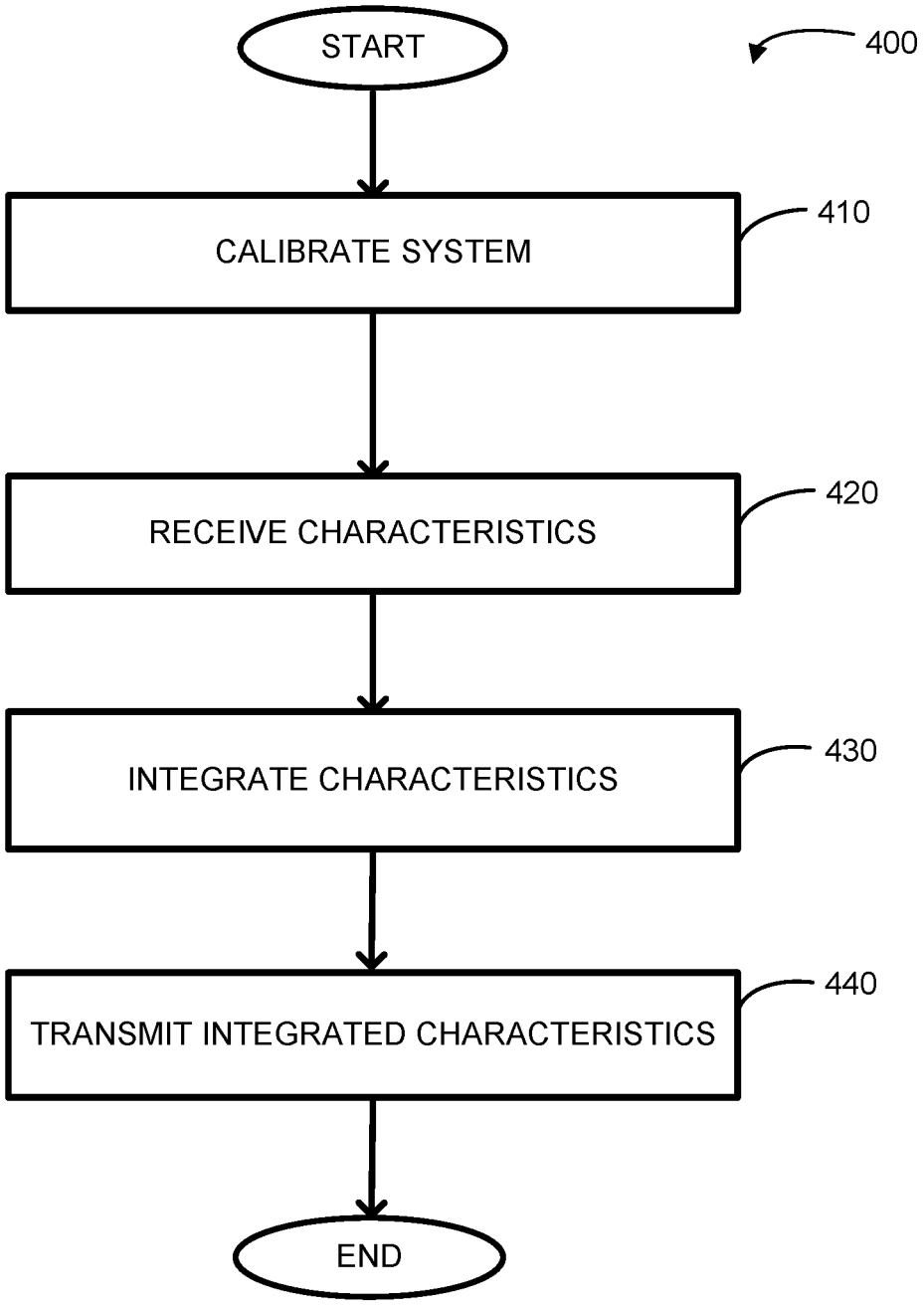
FIG. 4 is a flowchart of a method in accordance with one or more of the present embodiments.

Methods are provided for integrating measurements captured during a golf swing. For example, FIG. 4 is a flowchart of a method in accordance with one or more of the present embodiments. Method 400 is provided for integrating golf club and golf ball characteristics captured during a golf swing. The method may be performed using the one or more of the systems depicted in FIGS. 1-3, or using another system.

At 410, the system is calibrated. For example, in a system using an optical launch monitor and a motion sensor, the optical launch monitor may be aligned relative to the golf ball and a target. In this example, the optical launch monitor may be aligned with the golf ball and a target, and the motion sensor may be synced with the optical launch monitor. In this way, only one of the devices must be aligned, with the motion sensor leverage information from the optical launch monitor. Additional and different sensors may be calibrated and/or synced within the system. Other calibrations may also be performed, such as calibrating the sensors for specific course and weather conditions.

At 420, the system receives characteristics captured during the golf swing. In the example discussed above, the system receives golf ball characteristics and/or golf club characteristics from the optical launch monitor. The system also receives golf club characteristics captured by the motion sensor. Additional or different characteristics and data may be received, such as from additional or different sensors. The system may receive the characteristics from each sensor simultaneously. Alternatively, the system may receive characteristics sequentially from each sensor as the characteristics become available after a golf swing.

At 430, the system integrates the received characteristics. For example, integrating the characteristics may include selecting a subset of the characteristics, such as based on the expected accuracy of each characteristic. For example, the expected accuracy may be based on the technology by which the characteristic was measured or estimated. Integrating the characteristics may also include applying an offset to one or more of the characteristics. In one example, offsets are applied to better compare characteristics captured by different technologies. In another example, offsets are applied to align characteristics captured by different technologies, such as when a launch monitor or other sensor is misaligned with the intended target line.

At 440, the integrated characteristics are transmitted to a user device. For example, the characteristics are transmitted to a user device for display and/or to provide a recommendation to a user. In this example, the recommendation may include a swing technique recommendation, a club fitting recommendation, a club selection or distance recommendation, or another recommendation based on the integrated characteristics captured during the golf swing.

Any of the method acts 410-440 may be repeated, such as to analyze additional golf shots, and the received characteristics may be aggregated and stored for deeper analysis and to provide additional features to the user.

Figure 5:
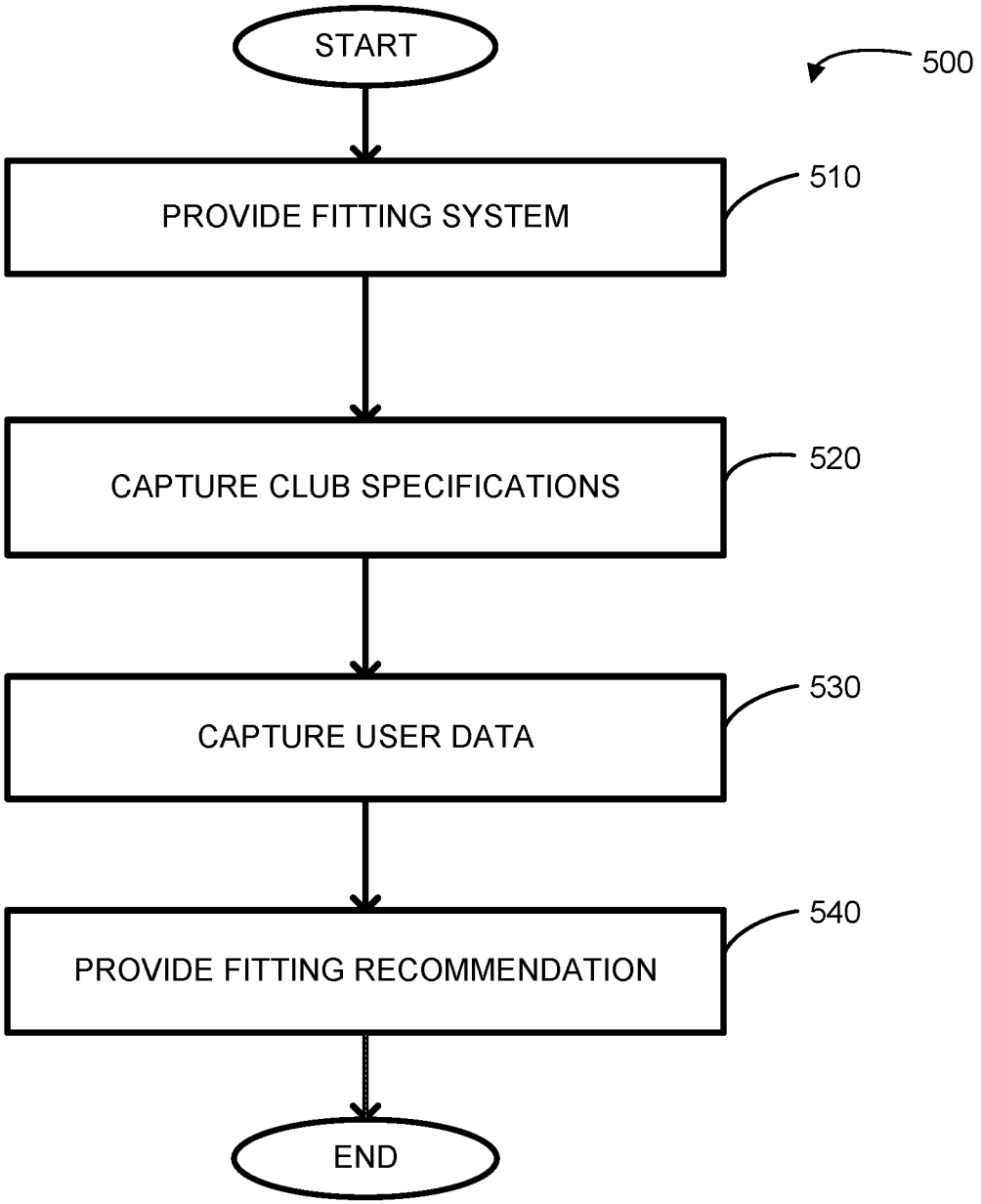
FIG. 5 is a flowchart of another method in accordance with one or more of the present embodiments.

FIG. 5 is a flowchart of another method in accordance with one or more of the present embodiments. Method 500 is provided for integrating data captured during a golf swing to provide fitting recommendations to a user. In an embodiment, the fitting application is configured to compare golf clubs, such as when choosing between brands, models, styles, specifications, shafts, and other club differences. The method may be performed using the one or more of the systems depicted in FIGS. 1-3, or using another system.

At 510, a fitting system is provided. For example, a software application may be communicatively coupled to one or more launch monitors and/or other data acquisition devices, one or more other sensors, one or more memories and databases, and one or more club tags. In one example, a standalone kiosk is provided for users to obtain fitting recommendations without the help of a club fitter. For example, unattended users may access the fitting system, using the software application logic to suggest club specifications without the need of a club fitter. In another example, a mobile fitting application is provided for club fitting, such as My Fitting Experience by TaylorMade Golf. The data acquisition devices may include a motion sensor, a video camera, an instrumented ball or another device.

At 520, the fitting system captures golf club specifications. In an example, the fitting system is accompanied by a fitting cart or other array of golf club heads, shafts and other golf club configurations for user testing during the fitting process. Each golf club shaft, head, or golf club configuration may be tagged to identify the golf club specifications in the fitting system. The golf club specifications may also include club head, shaft, flex, length, lie, loft, weight configuration(s), adapter configuration(s) (e.g., flight control technology (FCT) by TaylorMade Golf), and other specifications. In an embodiment, different tags are provided for the golf club head, club shaft, and/or other components to identify each component separately. The golf clubs may be tagged using Bluetooth tags, RFID tags, bar codes, or other tags. For example, the Bluetooth tags may be provided as Bluetooth stickers, Bluetooth screws, or other types of Bluetooth tags. The Bluetooth tags may be powered by a battery or may be powered using radio waves emitted by a Bluetooth receiving device, stray radio waves, solar energy, or another battery-less method of transmitting energy. The tags may communicate wirelessly, such as using radio signals, optical signals, auditory signals, or another signal type. Alternatively or additionally, the fitting system may deploy a camera and image recognition software to identify the golf club specifications. When running the software application on the fitting system, the user may wave the club and/or tag in front of a sensor to automatically capture the club specifications. In an embodiment, the club tags are also motion sensors for capturing additional swing data, and may work in conjunction with a video camera, launch monitor, or another device.

At 530, the fitting system captures user data. For example, after capturing the golf club specifications, the system captures user data as the user tests the golf club configuration. The one or more launch monitors and/or one or more other sensors capture launch conditions and other metrics relevant to fitting equipment for the user. In an example, motion sensors are used to capture swing mechanics, such as delofting the club at impact, tempo, and other metrics. A launch monitor may also capture golf ball launch parameters, such as launch angle, spin, carry distance, total distance, and additional metrics. In an embodiment, a data acquisition device captures and automatically communicates initial launch parameters to the fitting application. The fitting application may associate the initial launch conditions and the identification data. The associated data may be stored in the memory coupled to the fitting application, such as in a database associated with a particular user.

Additionally, the fitting system may integrate user data from other sources. For example, if a user logs shot data, such as using Arccos Golf, the fitting system may integrate the user's existing data. Integration of data from other sources may allow the user to compare existing equipment to new equipment during the fitting, may provide the user with a summary before or during the fitting, and may provide additional features to the user. The fitting system may also analyze the user data to identify tendencies of the user, such as percentage of fairways hit, shot dispersion tendencies, typical distances with existing equipment, and other tendencies. Integrating user data may also allow the fitting system to establish baselines and recommend starting club specifications for testing.

At 540, the system displays the associated initial launch conditions and identification data to the user and provides a fitting recommendation. Based on the data captured, the fitting system may recommend a different club specification for further testing, or confirm that a particular club specification provides desired launch conditions and/or other performance characteristics.

Any of the method acts 510-540 may be repeated, such as to analyze and test additional club specifications, and the received user data may be aggregated and stored for use in later analysis and club fittings.

Figure 6:
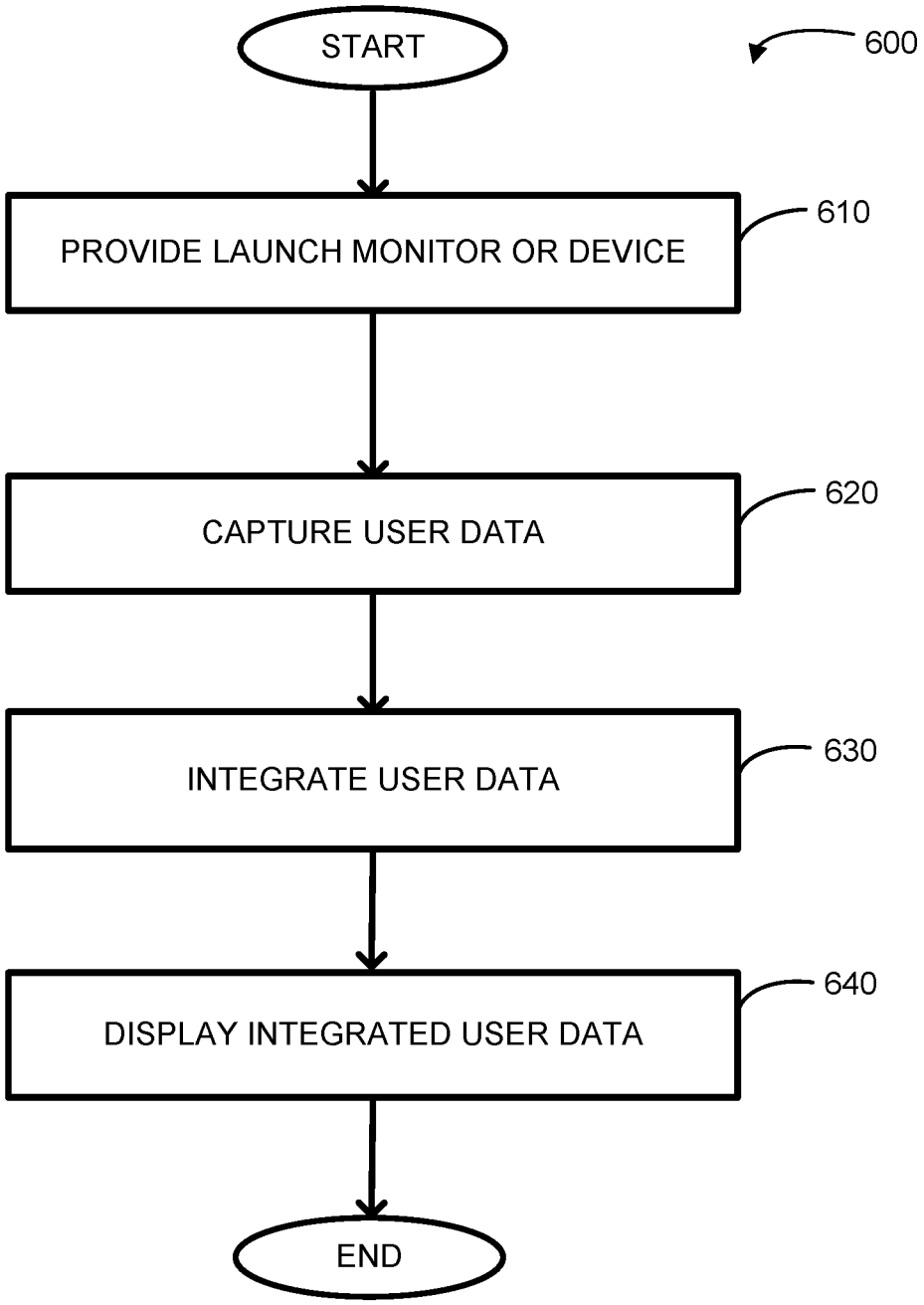
FIG. 6 is a flowchart of another method in accordance with one or more of the present embodiments.

FIG. 6 is a flowchart of another method in accordance with one or more of the present embodiments. Method 600 is provided for integrating data captured during a golf swing by a training platform. The method may be performed using the one or more of the systems depicted in FIGS. 1-3, or using another system.

In one or more embodiments, a training platform is provided to seamlessly present a user with golf ball, golf club and golf swing metrics between different launch monitors and/or other sensor devices. As discussed above, measurements captured during a golf swing, as well as calculations based on those measurements, may be represented differently by different launch monitors and/or other sensors. For example, some radar launch monitors may capture an angle of attack that is 1.5 degrees less than optical launch monitors. As such, the same swing may be represented differently depending on what device is used to measure the golf swing. In order to present consistent metrics to the user, a training platform and executing method 600 may be provided to adjust the measurements captured by the different devices and present the adjusted measurements to the user.

At 610, a launch monitor and/or another sensor device is provided for use with the training platform. For example, the training platform identifies the launch monitor and/or sensor device to be used. Identifying the launch monitor and/or sensor device allows the training platform to identify any offsets or other computations necessary to offset and/or align the measurements received by the training platform.

At 620, the launch monitor and/or sensor device captures user data during a golf swing and transmits the user data to the training platform. In some embodiments, the golf club is tagged so that the training platform automatically receives information on what club, or what club specifications, are being used during the golf swing. For example, each golf club, or components of the golf club, are tagged to be identified by the training platform. For example, at an initializing stage, each golf club is associated with a tag and entered into the training platform. The tag may identify which club is being hit, the specifications of the club, such as club head, shaft, flex, length, lie, loft, weight configuration(s), adapter configuration(s) (e.g., flight control technology (FCT) by TaylorMade Golf), and other specifications. In an embodiment, different tags are provided for the golf club head, club shaft, and/or other components to identify each component separately. The golf clubs may be tagged using Bluetooth tags, RFID tags, bar codes, or other tags. The tags may communicate wirelessly, such as using radio signals, optical signals, auditory signals, or another signal type. Alternatively or additionally, the training platform may deploy a camera and image recognition software to identify the golf clubs.

At 630, the user data is integrated based on the identified offsets and/or other computations. In reference to the example above, if a radar launch monitor is being used, the angle of attack measurement may be offset by adding 1.5 degrees to the measurement before storing the measurement and associating the measurement with the user in a database. Additional and different offset and other computations may be applied to integrate the received user data.

At 640, the integrated measurements are displayed to the user. By applying the offset and/or other computation to the user data prior to display, the user is seamlessly presented with consistent measurements when switching between a variety of different launch monitors and sensor devices. By way of example, if a user is attempting to hit up on the ball with a driver, offsetting the angle of attack measured by the radar launch monitor and displaying the integrated measurement may allow the user to more accurately evaluate the golf swing using different devices. As such, similar swings will result in similar measurements irrespective of the launch monitor used to measure each swing.

Any of the method acts 610-640 may be repeated, such as to use additional devices with the training platform.

Additional Embodiments

A method is provided for calibrating a golf tracking application. The method can include: initializing, for a user of the golf tracking application, the golf application with golf club specifications; capturing initial launch parameters for the user; generating extrapolated user data based on the initial launch parameters; and calibrating the golf application based on the extrapolated user data. Capturing initial launch parameters for the user can use least one of a launch monitor, a motion sensor, a video camera, and an instrumented ball. The method can also include providing a playing recommendation using the calibrated golf tracking application. The playing recommendation can be a club selection and/or odds for making par based on a club selection. The initial launch parameters can include at least one of carry distance, spin, launch angle and dispersion. Generating extrapolated user data can include auto-populating estimated carry distances for golf clubs of the user. Capturing initial launch parameters for the user can include capturing initial launch parameters for a predetermined number of golf shots with a single golf club. Generating extrapolated user data can include auto-populating estimated carry distances for other golf clubs of the user. Capturing initial launch parameters for the user can include capturing initial launch parameters for a predetermined number of golf shots with different single golf clubs.

A golf club fitting system can also be provided. The golf club fitting system can include: a fitting application configured to compare a plurality of golf clubs; a memory associated with the fitting application; a plurality of golf club tags, each tag coupled to one of the plurality of golf clubs and configured to automatically communicate identification data to the fitting application; and a data acquisition device configured to automatically communicate initial launch parameters to the fitting application. The fitting application can be configured to associate and store the initial launch conditions and the identification data in the memory, and can be configured to display the associated initial launch conditions and identification data. The golf club tags can be configured to communicate via at least one of Bluetooth signals, radio-frequency identification (RFID) signals, optical signals, and auditory signals. The data acquisition device can be at least one of a launch monitor, a motion sensor, a video camera, and an instrumented ball. The plurality of golf club tags can include a first tag coupled to a head of one of the plurality of golf clubs and a second tag coupled to a shaft of one of the plurality of golf clubs. Each of the golf club tags can be coupled to a grip of one of the plurality of golf clubs. The golf club tags can be motion sensors. At least one of the fitting application and the memory can be hosted on a cloud server. The fitting application can be configured for at least one of a tablet computer, a mobile phone, a personal computer, and a standalone kiosk. The memory can be configured to store golf club specifications associated with the identification data. The identification data can include at least one of a loft, a lie, a shaft flex, a shaft length, a weight, a brand name, and a model name or number. The fitting application can be further configured to display a fitting recommendation based on the associated initial launch conditions and identification data.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

The invention claimed is:

1. A kiosk for providing automated golf club fitting recommendations, the kiosk comprising:

a user input device, configured to receive golf fitting input data from a user;

an optical launch monitor, configured to capture first golf fitting sensed data corresponding with first measured characteristics;

a radar launch monitor, configured to capture second golf fitting sensed data corresponding with second measured characteristics;

a host computer, configured to receive the first golf fitting sensed data from the optical launch monitor and the second golf fitting sensed data from the radar launch monitor to determine a golf club fitting recommendation based at least partially on the golf fitting input data, the first golf fitting sensed data, and the second golf fitting sensed data; and an information output device configured to communicate the golf club fitting recommendation to the user.

2. The kiosk according to claim 1, wherein at least one measured characteristic of the first measured characteristics is the same as at least one measured characteristic of the second measured characteristics.

3. The kiosk according to claim 1, wherein the host computer is wirelessly communicatively coupled with the optical launch monitor and the radar launch monitor.

4. The kiosk according to claim 3, wherein the host computer is wirelessly communicatively coupled with the optical launch monitor and the radar launch monitor via one of a wi-fi communication protocol or a Bluetooth communication protocol.

5. The kiosk according to claim 1, wherein the optical launch monitor comprises a camera.

6. The kiosk according to claim 5, wherein:

the camera is configured to capture measurements of at least one of a golf ball and a golf club during a golf swing, in which the golf club impacts the golf ball; and the first golf fitting sensed data comprises the measurements captured by the camera.

7. The kiosk according to claim 6, wherein at least one of the first measured characteristics or the second measured characteristics comprises one or more of ball launch angle and ball spin.

8. The kiosk according to claim 1, further comprising a motion sensor fixable to the user and configured to capture third golf fitting sensed data, wherein the golf club fitting recommendation is further based at least partially on the third golf fitting sensed data.

9. The kiosk according to claim 1, wherein the optical launch monitor and the radar launch monitor are movable relative to the host computer.

10. The kiosk according to claim 1, wherein each one of the optical launch monitor and the radar launch monitor is movable, relative to the host computer, into a position that is a corresponding one of down-the-line from or face-on to a golf ball to be struck by a golf club during a golf club fitting process.

11. The kiosk according to claim 1, wherein:

the user input device comprises a first camera, configured to measure one of a golfer, a golf ball, or a golf club during a golf fitting process; and the optical launch monitor comprises a second camera.

12. The kiosk according to claim 11, wherein:

the first camera is fixed relative to the host computer, such that the first camera is not movable relative to the host computer; and the second camera is movable relative to the first camera.

13. The kiosk according to claim 1, wherein the golf fitting input data comprises golf club specifications.

14. The kiosk according to claim 13, wherein the golf club specifications are automatically uploaded to the user input device in response to a selection, by the user, of a golf club during a golf club fitting process.

15. The kiosk according to claim 1, wherein the user input device is a touchscreen.

16. The kiosk according to claim 1, wherein the information output device is a touchscreen.

17. The kiosk according to claim 1, wherein:

the user input device and the information output device are combined into a single device; and the single device is a touchscreen.

18. The kiosk according to claim 1, wherein at least one of the user input device and the information output device is a natural user interface (NUI) device.

19. The kiosk according to claim 1, wherein:

the user input device comprises speech-recognition software and a voice user interface; and the user input device is configured to receive the golf fitting input data from the user via the voice user interface.

20. The kiosk according to claim 1, wherein the kiosk is configured to provide golf club fitting recommendations without input from or interaction with a human club fitter.

21. The kiosk according to claim 1, wherein at least one of the first measured characteristics or the second measured characteristics comprises shot dispersion data.

* * * * *